US005138971A

United States Patent [19]

Nakajima et al.

[11] Patent Number: 5,138,971

[45] Date of Patent: Aug. 18, 1992

[54] WEB CHARGING APPARATUS

[75] Inventors: Kenji Nakajima; Atuo Futami, both of Kanagawa, Japan

[73] Assignee: Fuji Photo Film Co., Ltd., Kanagawa, Japan

[21] Appl. No.: 721,001

[22] Filed: Jun. 26, 1991

[30] Foreign Application Priority Data

Jul. 3, 1990 [JP] Japan ..... 2-174367

[51] Int. Cl.[5] ..... B05D 3/14

[52] U.S. Cl. ..... 118/624; 427/141; 427/27; 118/625; 118/627

[58] Field of Search ..... 118/72, 624, 625, 627; 156/583.2; 427/39, 40, 41, 14.1, 27

[56] References Cited

U.S. PATENT DOCUMENTS 5,074,240 12/1991 Honma ..... 118/625

FOREIGN PATENT DOCUMENTS 55-142565 11/1980 Japan .

*Primary Examiner*—Kenneth M. Schor
*Assistant Examiner*—Charles K. Friedman
*Attorney, Agent, or Firm*—Sughrue, Mion, Zinn, Macpeak & Seas

[57] ABSTRACT

A web charging apparatus, for use in a coating system for applying various coating liquids onto a web which has been previously charged by a static field in which conductive wires form a corona discharge electrode. The diameter of the wires is in a range of 100–200 μm, and the tension of the wires is not less than 1 kg. Intermediate holding frames for holding the wires are also provided. The web charging apparatus reduces the voltage irregularities in the width direction of the web and the irregular thickness of the coating liquid in the transfer direction.

10 Claims, 2 Drawing Sheets

WEB CHARGING APPARATUS

BACKGROUND OF THE INVENTION

The present invention relates to an electrode for charging a continuously running belt-like support (hereinafter referred to as "a web") to produce a static field used when coating a web with any of various kinds of liquid compositions in manufacturing photosensitized material film, photographic print paper, magnetic recording tapes, adhesive tape, pressure-sensitive paper, heat-sensitive paper, photosensitised printing plate, etc.

A coating system useful for coating various liquid compositions (hereinafter referred to as "a coating liquid") onto a web using a static field is described in Japanese Patent Publication No. Sho. 49-7050 and Japanese Laid-Open Patent Application No. Sho. 55-142565.

In this system, the static field is used to improve the adhesion between the web and the coating liquid. For this purpose, a web charging electrode is disposed upstream of the coating point adjacent the moving web. With this system, a variety of improvements in the coating process are realized, for example, easy starting of high speed coating and better protection of thick coatings. Furthermore, the system can be used with many different types of coating systems.

However, a problem arises with respect to a curtain coating method, which is required to perform coating at a very high speed. In a curtain coating method for a web of width not less than one meter and which is charged with a unipolar electric charge, there is generally employed a corona discharge apparatus which is provided with a set of electrically conductive wires acting as a corona discharge electrode and a rotatable roller supporting the web and acting as a grounding electrode. This apparatus has various problems caused by potential and charge irregularities over the surface of the web. Specifically, an irregular thickness (step unevenness) of the coating liquid is caused by longitudinal (transfer direction of the web) voltage irregularities, and liquid exhaustion tends to occur at the edge portions of the web due to an irregular voltage distribution in the width direction of the web as a result of a difference of the amounts of discharge between the center of the wire electrode and the opposite ends of the wires of the electrode.

SUMMARY OF THE INVENTION

It is an object of the present invention to provide a web charging apparatus in which the above problems in the conventional art are solved, and in which the voltage irregularities of the transfer direction and the width direction are reduced so that thickness variations of the coating liquid are reduced and the problem of liquid exhaustion at the edge portions of the web is solved.

The inventors have determined that the step unevenness of the coating liquid as the result of an irregular voltage in the longitudinal direction of the web is caused by vibration of the electrically conductive wires of the web charging apparatus, and the liquid exhaustion at the edge portions of the web is caused by irregularities of the voltage distribution.

Accordingly, the present invention resides in the determination of preferable materials for the electrically conductive wires of the electrode, the spacing between the wires and the distance from the web to the electrode, whereby voltage irregularities in the transfer direction and the width direction of the web are reduced.

Specifically, the aforesaid objects are achieved by means of a web charging apparatus in which a web having a width of at least one meter is charged with a unipolar electric charge, and in which electrically conductive wires are provided as a corona discharge electrode, wherein the diameter of the electric conductive wires is in a range of 100–200 μm, the tension of the wires is not less than 1 kg, and wherein the web charging apparatus is provided with intermediate holding frames for holding the wires, the frames being disposed at an interval of not less than 300 mm from each other.

Furthermore, each intermediate holding frame is shifted in the longitudinal direction on each wire from the superposed position along the wires in the transfer direction with respect to the holding frames of the immediately previous adjacent wire with each shift being about 20 mm, whereby the intermediate frames are not superposed (aligned) in the common transfer direction with each other.

Moreover, the distance from the edge of the wires of the electrode to the web is preferably less than the distance from the middle of the wires to the web.

In the present invention, for the electrically conductive wires, tungsten wire, molybdenum wire, carbon fiber, and the like, can be used. For restricting the discharge start voltage to a preferable value, the diameter of the wire is made less than 200 μm, as described above. For attaining a breaking strength of not less than 1 kg, the diameter of the wire should be not less than 100 μm, as also mentioned above.

BRIEF DESCRIPTION OF THE DRAWINGS

FIG. 3(*b*) is a front view of the intermediate frame shown in FIG. 3(*a*)

DESCRIPTION OF THE PREFERRED EMBODIMENTS

Figure 1:
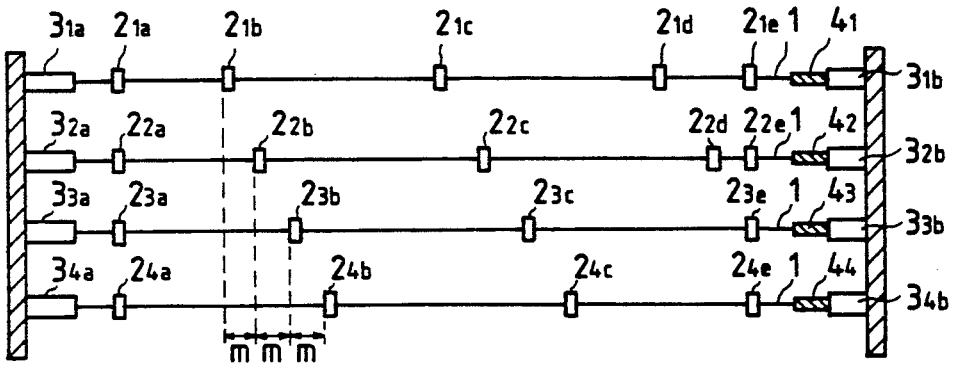
FIG. 1 is a plan view for explaining a preferred embodiment of the corona discharge electrodes of the web discharging apparatus according to the present invention.

In the present invention, as shown in FIG. 1, in order to maintain the tension of the wire at not less than 1 kg, first ends of the wires 1 are fixed to respective ones of fixed supports $\mathbf{3}_{1a}$–$\mathbf{3}_{4a}$ and the other ends are fixed to respective slidable supports $\mathbf{4}_1$–$\mathbf{4}_4$. The slidable supports $\mathbf{4}_1$–$\mathbf{4}_4$ are held to the fixed supports $\mathbf{3}_{1b}$–$\mathbf{3}_{4b}$, respectively, by air cylinders, coil springs, or the like (not shown).

The slidable supports $\mathbf{4}_1$–$\mathbf{4}_4$ shown in FIG. 1 may be linked with the air cylinders or coil springs so as to separately adjust the tension of each of the wires. On the other hand, a plurality of slidable supports can be mounted on a common support and the common support mounted on a fixed support through an air cylinder or coil spring.

The intermediate frames $\mathbf{2}_{1a}$–$\mathbf{2}_{1b}$ support the wires at points spaced at an interval of not more than 300 mm, so that vibration of the wires is suppressed. As a result, the voltage distribution in the transfer direction of the web becomes more even.

The intermediate frames 2 are formed of nonconductive materials having a resistivity greater than $10^{15}\Omega\cdot$cm (at 50%RH, 25° C.). For example, fluorocarbon of polytetrafluoroethylene (PTFE) or the like, polyolefinoid of polyethylene (PE), polypropylene (PP) or the like can be used to form the frames.

Figures 3A, 3B:
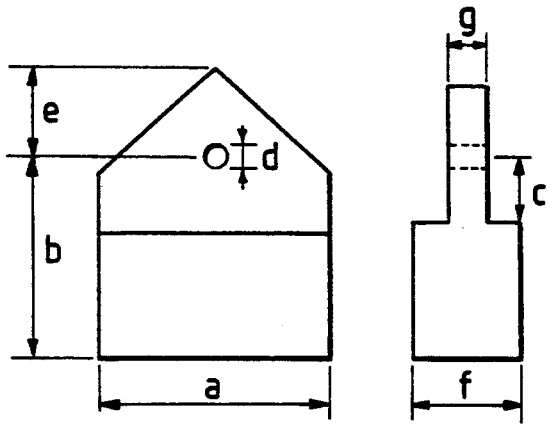
FIG. 3(*a*) is a side view for explaining an embodiment of the intermediate frame according to the present invention.

The intermediate frames 2 are constructed as shown in FIG. 3. Preferable dimensions for the frames are: bottom width a=10–15 mm, diameter of hole d for passing the electrically conductive wires (height b>20 mm from the bottom) from twice the wire diameter to 0.5 mm, thickness g of the intermediate frame at the passing hole=1–0.5 mm, distance e from the hole to the top of the intermediate frame=1–0.5 mm, and distance c from shoulder of thickness f part to hole≧5 mm.

In the present invention, as shown in FIG. 1, each intermediate holding frame is shifted in the longitudinal direction on each wire from a superposed (aligned) position on the wires in the transfer direction with a shift of m≧20 mm from the immediately previous adjacent wire, whereby the intermediate frames are not superposed in the common transfer direction. Accordingly, the corona discharge distribution along the wire electrode in the transfer direction becomes more even.

Figure 2:
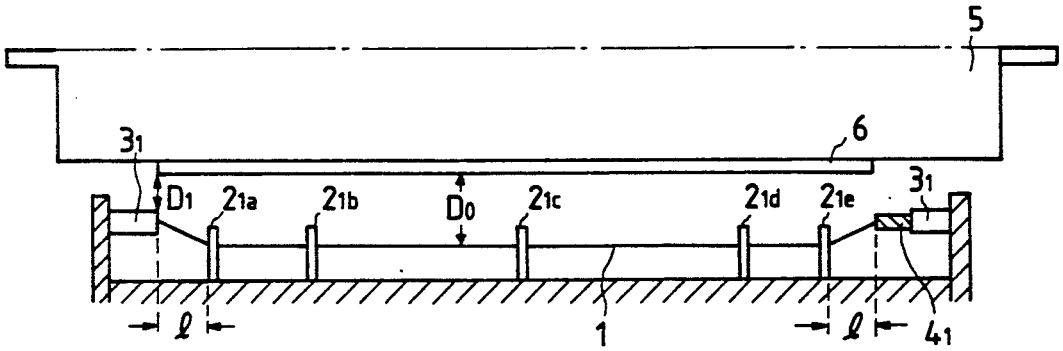
FIG. 2 is a side view of the corona discharge electrodes shown in FIG. 1.

On the other hand, since the distance from the ends of the wires to the web is less than the distance from the middle of the wires to the web, the corona discharge at the end $3_1$ of the wire, which would otherwise be weaker than that at the middle portion, is compensated. Namely, as shown in FIG. 2, the distance $D_0$ from the middle of the wire electrodes to the web is greater than or equal to the distance $D_1$ from the ends of the electrodes to the web so as to obtain an even distribution in the longitudinal direction of the wire. This condition is primarily obtained by design of the support 3 adjacent the web, rather than the intermediate frame 2.

Specific examples of the present invention will be described in detail below.

EXAMPLE 1

A preferred embodiment for reducing the voltage irregularities in the transfer direction of the web.

Figure 4:
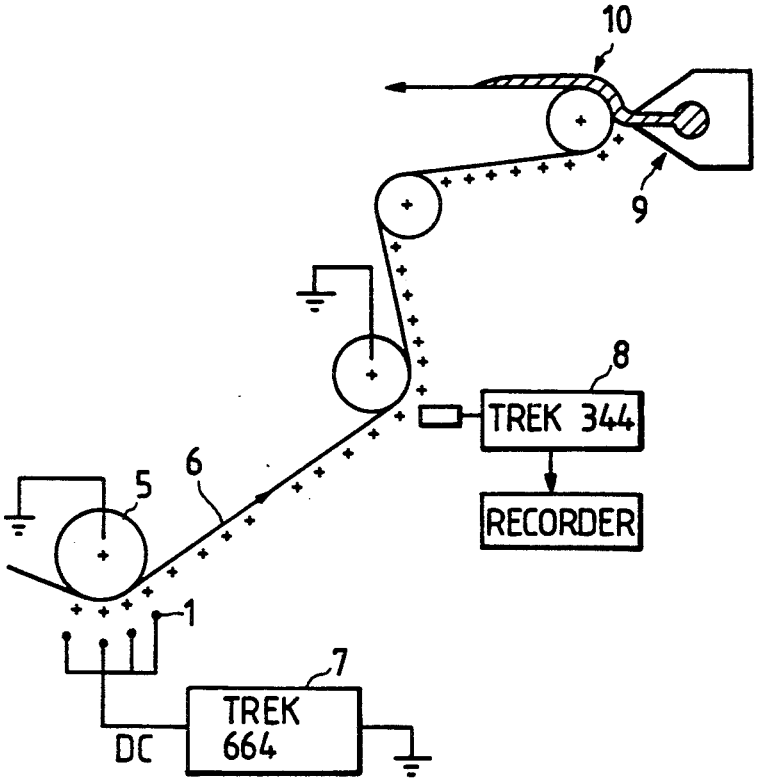
FIG. 4 is a side view of an example of a liquid coating system employing the present invention.

In this example, a web printing paper web, namely, a paper covered by polyethylene, was transferred at a speed of 200 m/min and coated with a coating liquid, as shown in FIG. 4. Wire electrodes 1 were supplied a voltage of 6,500 V from a DC high-voltage power supply 7 (TREK Corp. Model 664). The surface electric potential at the middle portion of the web was measured by a surface electric potential measuring instrument 8 (TREK Corp. Model 344).

The wire electrodes 1 was composed of four parallel tungsten wires of a diameter of 150 μm and a length of 1.5 m. The wire electrodes 1 were disposed above the web 6 with a center distance of 5 mm.

In comparative examples, the tension of the wire electrodes was set at values of 100 g, 500 g and 1000 g. The intermediate frames for each wire were disposed at an interval of≦300 mm, and each intermediate frame of each wire was shifted a distance 25 mm. Under these conditions, the amplitude of the voltage irregularities and the step unevenness of the coating liquid 10 supplied by the coating die 9 were measured. The results are shown in Table 1.

The coating liquid included 5 wt% colloidal silver having an average grain diameter of 0.1 μm and 10 wt% of alkali-treated gelatin. The coating amount per unit area of the web was 60 ml/m².

TABLE 1

| | Electrode Conditions | | Voltage | |
|---|---|---|---|---|
| | Wire Tension (g) | Intermediate Frames | Irregularity Amplitude (V) | Step Unevenness |
| Comparative Examples | 100 | none | 200 | present |
| | 500 | none | 120 | present |
| | 500 | present | 90 | weak |
| | 1000 | none | 80 | weak |
| Example | 1000 | present | 40 | none |

As shown in Table 1, as a result of setting the wire tension at 1000 g and properly disposing the intermediate frames, the voltage irregularity amplitude was reduced to 40 V, and the occurrence of step unevenness was reduced.

EXAMPLE 2

An embodiment for reducing the voltage irregularities in the web width direction.

When the correction for discharging charge distribution on the wire is not performed, the discharging charge distribution gradually falls off at wire end portions about 20 mm from the ends of the wires (for a surface resistance of the web of not less than $10^{12}\ \Omega$ at normal temperatures). Thus, drop-off of the charge distribution is shown in Table 2 below as a ratio of the charge amount of the edge portion to the center portion.

TABLE 2

| Distance from end (mm) | 0 | 5 | 10 | 15 | 20 |
|---|---|---|---|---|---|
| Ratio of charge amount of end portion to center portion | 0.3 | 0.5 | 0.8 | 0.9 | 1.0 |

It is desirable that the discharging charge distribution shown in Table 2 be corrected as shown in Table 3, relative to a distance $D_0$ from the web to the center of the wire, on the basis of the approximation $A=26\times10^{-0.49D}$. (A=discharging charge amount, D=distance from the web to the wire, and the diameter of each wire electrode is in a range of 80–300 μm).

TABLE 3

| Distance from end (mm) | 0 | 5 | 10 | 15 | 20 |
|---|---|---|---|---|---|
| Distance from web to wire (mm) | $D_0$–1.1 | $D_0$–0.6 | $D_0$–0.2 | $D_0$–0.1 | $D_0$ |

On the other hand, the distance from the web to the wires may be shifted at a linear rate by disposing the intermediate frames $2_a$ and $2_e$ at respective positions about 40 mm from the respective ends of the wire.

The embodiment of Example 2 was employed in the system shown in FIG. 4 using a web and coating liquid as in Example 1, in which a four-wire electrode was used in which the wires had a diameter of 150 μm and a length of 1.5 m. Furthermore, the distance $D_0$ from the web to the center of the wire was 5 mm, and the distance $D_1$ from the web to the end of the wire was 3.9 mm, so that the wires sloped from a point l=40 mm from the end of the wires as shown in FIG. 2. When the transfer speed was 250 m/min and the wire was supplied a potential of 100 V at its center portion, the degree of liquid exhaustion at the edge of the web caused by an irregular voltage and irregular liquid coating was observed. The results are shown in Table 4.

TABLE 4

| Correcting distance | Voltage at edge of web | Liquid Exhaustion |
|---|---|---|
| none | 300 V | occurred |
| Correction shown in FIG. 2 | 800 V | none |

Moreover, the corona discharge effect at the edge of the web was sufficiently obtained.

From the above results, it was found that the web charging apparatus of the present invention reduces the voltage irregularities in the width direction of the web and the thickness irregularities of the coating liquid in the transfer direction, so that the problems of step unevenness and liquid exhaustion are satisfactorily solved. Accordingly, an improvement in coating quality and speed are obtained simultaneously.

What is claimed is:

1. An apparatus for charging a web of not less than one meter in width by unipolar electric charging before coating the web with a liquid composition, comprising:

a corona discharge electrode arranged adjacent said web, said corona discharge electrode comprising a plurality of parallel electrically conductive wires for charging said web, a diameter of said electrically conductive wires being in a range of 100–200 μm and a tension of said wires being not less than 1 kg;

fixture means for holding both ends of each of said wires;

base means for supporting said fixture means; and a plurality of intermediate frames for supporting said wires at intervals of not less than 300 mm, said intermediate frames being fixed to said base means.

2. The apparatus according to claim 1, wherein each of said intermediate frames, except end ones thereof, is shifted in a longitudinal direction of each said wire from a superposed position with respect to a previous immediately adjacent wire in a transfer direction of said web by a distance of ≦20 mm, such that said intermediate frames other than said end ones thereof are not superposed with one another in said transfer direction.

3. The apparatus according to claim 1, wherein a distance from ends of each of said wires to said web is less than a distance from a middle portion of said wires to said web.

4. The apparatus according to claim 1, wherein said wires are made of a material selected from the group consisting of tungsten, molybdenum, and carbon fiber.

5. The apparatus according to claim 1, wherein said fixture means comprises a plurality of slidable supports, one end of each of said wires being fixed to first ends of respective ones of said slidable supports, a plurality of fixed supports, and tensioning means coupling each of said slidable supports to a respective one of said fixed supports.

6. The apparatus according to claim 5, wherein said tensioning means comprises a plurality of air cylinders.

7. The apparatus according to claim 5, wherein said tensioning means comprises a plurality of coil springs.

8. The apparatus according to claim 1, wherein each of said intermediate frames has a hole therein for passing a respective one of said wires, and each of said intermediate frames has dimensions in the following ranges:

bottom width: 10 to 15 mm diameter of hole for passing wire: twice wire diameter to 0.5 mm distance of hole from bottom of frame: >20 mm thickness of intermediate frame at hole: 1 to 0.5 mm distance of hole to top of frame: 1 to 0.5 mm.

9. The apparatus according to claim 1, wherein said intermediate frames are made of a material having a resistivity greater than $10^{15}\Omega\cdot$cm.

10. The apparatus according to claim 1, wherein said intermediate frames are made of a material selected from the group consisting of fluorocarbon of polytetrafluoroethylene, polyolefinoid of polyethylene, and polypropylene.

* * * * *